United States Patent [19]

LeDoux

[11] Patent Number: 4,692,850

[45] Date of Patent: Sep. 8, 1987

[54] LAMP FOR TEMPORARILY ATTACHING TO A SUPPORT

[76] Inventor: John P. LeDoux, 1509 Old Fashion Way, Anaheim, Calif. 92804

[21] Appl. No.: 814,329

[22] Filed: Dec. 30, 1985

[51] Int. Cl.[4] ..... F21S 1/02

[52] U.S. Cl. ..... 362/432; 362/427; 362/419; 362/285

[58] Field of Search ..... 362/413, 421, 427, 419, 362/414, 396, 269, 285, 432

[56] References Cited

U.S. PATENT DOCUMENTS

| | | | |
|---|---|---|---|
| 1,778,568 | 10/1930 | Schulte | 362/396 |
| 4,484,255 | 1/1984 | Warshawsky | 362/414 |
| 4,528,622 | 7/1985 | Bacevius | 362/396 |

FOREIGN PATENT DOCUMENTS

| | | | |
|---|---|---|---|
| 713883 | 8/1954 | United Kingdom | 362/421 |

*Primary Examiner*—E. Rollins Cross

*Attorney, Agent, or Firm*—Herb Boswell

[57] ABSTRACT

A lamp has an elongated hollow neck with a lighting fixture attached to one of its ends. The other of its ends is attached to a main bracket. The main bracket includes one of either a set of elongated parallel ribs or a set of elongated parallel grooves. A secondary bracket is attached to a support surface and includes the other of either the elongated ribs or the elongated grooves. The main bracket is attached to the secondary bracket by sliding the ribs into the grooves to temporarily attach the lamp fixture to the secondary bracket so at to hold the lamp fixture in a temporary position against a support surface on which the secondary bracket is attached.

11 Claims, 4 Drawing Figures

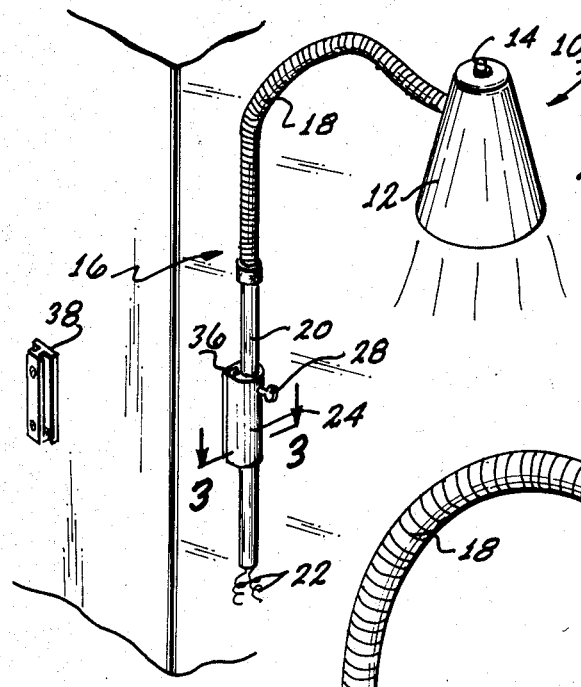
Fig. 1
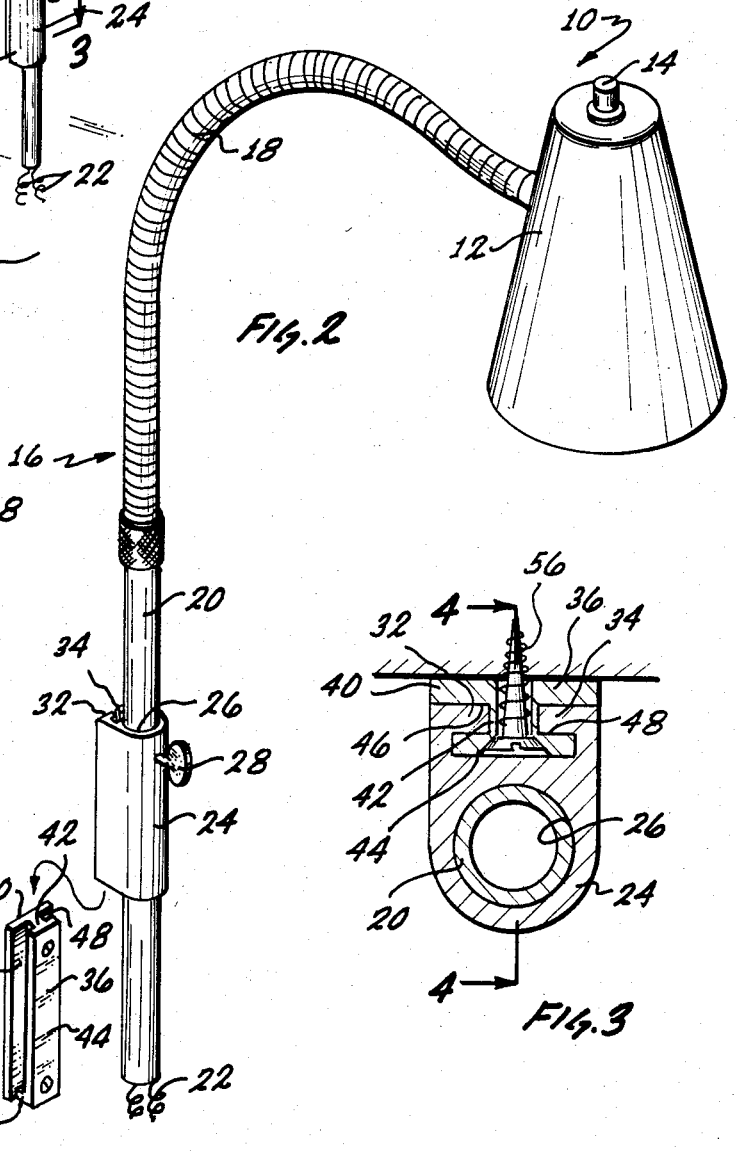
Fig. 2
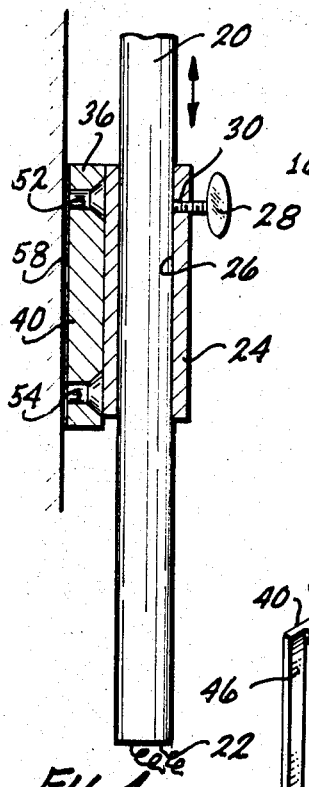
Fig. 4
Fig. 3

LAMP FOR TEMPORARILY ATTACHING TO A SUPPORT

BACKGROUND OF INVENTION

This invention is directed to a lamp which has a main bracket having a lamp neck and a lighting fixture attached thereto. One or more secondary brackets are utilized in conjuction with the main bracket with the secondary brackets being afixed to appropriate support surfaces. The main bracket temporarily mates with one of the secondary brackets to temporarily position the lamp adjacent to the support surface on which the secondary bracket is attached.

A variety of reading lamps and other small work lamps are known. These generally can be catagorized as either one of two types.

The first type would be those which have a base which rests upon a table or other suitable horizontal support. Because the lamp is totally supported by the base, this type of lamp can only be utilized in conjunction with a horizontal support surface. As such this lamp is not suitable for use in association with chairs, sofas, recliners, and the like which are not located adjacent to tables or other structures having horizontal surfaces. Nor are they suitable for use with many types of beds which do not have a headboard having a horizontal surface thereon.

The other main type of light generally utilized for a reading or work light invludes a flexible neck which is attached to a clamping base such as a C-clamp structure or a pinch clamp structure. Certain of these are of very small design and can be attached directly to a book. Generally, however, these have an articulating arm and are of a form normally seen attached to drafting tables or artist's tables or the like. Because these lamps must, in essence, be clamped onto a narrow member such as a table top or the like, these lamps cannot be used in association with chairs, tables, recliners, headboards, and other devices which do not have a narrow plank-like member which is required for clamping of the lamp. Additionally, the design of these lamps generally is not of such an esthetic nature so as to be suitable for the use in a formal livingroom, offices, and the like.

While it is highly desirable to have a small lamp which can be utilized for reading without bothering other individuals who may be sleeping or watching TV, or for use in reading when sitting on a sofa, reclining chair, or the like, which is not next to a support surface, heretoafore such a lamp has not been availble.

BRIEF DESCRIPTION OF THE INVENTION

In view of the above, it is a broad object of this invention to provide a lamp which can be conveniently attached to vertical, inclined, or irregular surface. It is a further object of this invention to provide a lamp which can be temporarily attached to a bracket in a manner requiring no tools or the like, yet still have the lamp maintained on the bracket in a secure position. It is a further object of this invention to provide a lamp which can be attached to the back of sofas, recliners, bed headboard, and the like, allowing for positive positioning of the light emitted from the lamp with respect to the sofa, recliner, or bed.

These and other objects which will become evident from the remainder of this specification are achieved in a lamp which has one or more first bracket means which can be attached to support surfaces and a second bracket means which can be attached to the first bracket means. The first bracket means comprises an integrally formed elongated member having a front, back, top, a bottom, and essentially a parallel left and right side. The second bracket means also is elongated and includes at least a back, top, bottom, and left and right essentially parallel side edges. One of the first bracket means or the second bracket means includes first and second elongated grooves formed on one side of said first or said second bracket means. The first and second elongated grooves are located essentially parallel to one another and are spaced apart from one another and are oriented with respect to one another so as to open opposed to one another. The other of the first or second bracket means includes first and second elongated ribs. The first and second elongated ribs are located essentially parallel to one another, and sized and shaped and positioned on other of said first or said second bracket means in a space relationship such that the first elongated rib fits into the first groove, and the second elongated rib fits into the second groove to mate the second bracket means to the first bracket means. A limiting means is located on one of the first or second bracket means for maintaining the second bracket means mated to the first bracket means to temporarily attach the second bracket means to the first bracket means. An elongated lamp neck having ends and a hollow interior has an electric light attached to one of its ends and includes electrical wiring attached to the electrical light and passing through the hollow interior and exiting out the other of the ends of the hollow neck. The elongated lamp neck is operatively attached to the second bracket means proximal to the other of said ends of the neck. As such, the neck and the lamp attached thereto are supported by the second bracket means which in turn is supported on support surfaces.

BRIEF DESCRIPTION OF THE DRAWING

This invention will be better understood when taken in conjunction with the drawing wherein:

FIG. 1 is an isometric view showing the lamp of the invention attached to an appropriate support surface;

FIG. 2 is an exploded closeup view of the lamp of FIG. 1;

FIG. 3 is a plan sectional view about the line 3—3 of FIG. 1; and

FIG. 4 is an elevational view in partial section about the line 4—4 of FIG. 3.

This invention utilizes certain principles and concepts as are set forth in the claims appended hereto. Those skilled in the lamp arts will realize that these principles and/or concepts are capable of being utilized in a variety of embodiments which may differ from the specific embodiment utilized for illustrative purposes herein. For this reason this invention is not to be construed as being limited solely to the illustrative embodiment, but should only be construed in view of the claims.

DETAILED DESCRIPTION

In FIG. 1 there is shown a lamp 10 of the invention. The lamp 10 has several component parts, certain of those which are standard such as a typical shade 12, off/on switch 14, and an electrical lightbulb not shown in the Figures.

The lamp 10 includes a neck generally shown by the numeral 16 which includes a goose-neck portion 18 and a tubular portion 20. These are appropriately attached together so that, in total, they form the neck 16 which has the shade 12 attached to its upper end. The totality of the neck 16 is hollow so as to allow for electrical cords 22 to traverse through it to supply appropriate current to the unseen lightbulbs located within the shade 12.

A main bracket 24 either permanently or adjustably accepts a neck 16 of the lamp 10. In the illustrative embodiment shown in the Figure, the tubular portion 20 of the neck 16 is adjustably received by the main bracket 24. In further embodiments, however, the tubular portion 20 could be eliminated and the goose-neck portion 18 directly and permanently connected to the main bracket 24.

For the illustrative embodiment, the main bracket 24 includes a hollow elongated opening 26 which accepts the tubular portion 20 of the neck 16. A set screw 28 threads into a threaded opening 30 in the front of the main bracket 24. The set screw 28 allows for vertical adjustment of the neck 16 with respect to the main bracket 24. As can be seen in FIG. 3, the opening 26 in the main bracket 24 is sized with an internal diameter so as to accept the outside diameter of the tubular portion 20 of the neck 16 and allow for sliding of the tubular portion 20 up and down within the main bracket 24 for vertical adjustment of the neck 16 with respect to the main bracket 24.

The main bracket 24 further includes first and second elongated ribs 32 and 34 which extend along the left and right sides of the main bracket 24 on the rear of the main bracket toward one another. The left and right sides of the main bracket 24 are formed so as to be essentially straight and parallel and, as such, the elongated ribs 32 and 34 are also parallel to one another.

In FIG. 1, the main bracket 24 is shown as attached to the first secondary bracket 36. Also shown in FIG. 1 is a second secondary bracket 38. These two brackets, 36 and 38, are exactly the same structure and, as such, only the bracket 36 will be described in detail. In addition to the use of two secondary brackets, 36 and 38, as is shown in FIG. 1, further secondary brackets of exactly the same structure could also be utilized inconjunction with the lamp 10. As will be evident below, the main bracket 24 is easily attached and detached from any of the secondary brackets, such as brackets 36 and 38, allowing for positioning of a plurality of secondary brackets on different surfaces and convenient movement of the main bracket 24 and the components attached thereto from one of the secondary brackets to the other.

Each of the secondary brackets has a back portion 40, a web portion 42, and a front portion 44. The web 42 bases the front portion 44 away from the back portion 40 so as to define a first elongated groove 46 along the left hand side of the bracket 36, and a second elongated groove 48 along the right side of the bracket 36. Since the left and right side edges of the secondary bracket, such as bracket 36, are essentially parallel to one another, the first and second grooves 46 and 48 are also essentially parallel to one another and run along the left and right side edges from the top of the secondary brackets to the bottom of the secondary brackets with the web portion 42 separating the two grooves.

The elongated ribs 32 and 34, and the grooves 46 and 48, are sized and shaped such that the elongated ribs, 32 and 34, slide into the grooves 46 and 48 to mate the main bracket 24 to one of the secondary brackets, such as secondary bracket 36. The secondary bracket 36 further includes a limiting member 50 formed as a horizontally oriented planar projection from the front portion 44 of the bracket 36 along the web portion 42 to the back portion 40.

The main bracket 24 is mated to the secondary bracket 36 by sliding the ribs 32 and 34 of the main bracket 24 into the grooves 46 and 48 of the secondary bracket 36. The ribs 32 and 34 are introduced into the top of the grooves 46 and 48, and the main bracket 24 slid downwardly along the secondary bracket 36. When the bottom edges of the ribs 32 and 34 contact the limiting member 50, further sliding of the main bracket 24 down along the surface of the secondary bracket 36 is prevented, and the main bracket 24 is now temporarily held in its mating position against the secondary bracket 36. It is evident that the main bracket 24 and the components attached thereto are, thus, easily attached and detached to the secondary bracket 36.

Alternatively to positioning the limiting member 50 along the bottom of the secondary bracket 36, it could be positioned along the top of the main bracket 24 between the ribs 32 and 34. When so positioned, a limiting member on the main bracket 24 would strike the top of the web portion 42 of the secondary bracket 36 to prevent further downward movement of the main bracket 24 on the secondary bracket 36 to temporarily mate and hold the main bracket 24 to the secondary bracket 36.

The secondary brackets 36 and 38, and other identical brackets, can include openings or holes, such as openings 52 and 54, which extend from the front surface of the secondary brackets to their back surface. The orifices 52 and 54 would be counter-sunk into the front surface of the bracket 36, allowing for utilization of appropriate screws to attach the secondary bracket, such as bracket 36, to an appropriate support surface. Additionally, as is depicted in FIG. 4, the secondary bracket 36 could be attached to a supporting surface by utilizing an adhesive strip 58 which has appropriate adhesive on both its front and back surface such that it can serve to attach the secondary bracket 36 to the support surface. Such adhesive strips are conveniently available, as for instance an adhesive strip available from the 3M Company. The adhesive used on these strips are of such a nature that the bond produced by the adhesive strip is quite strong and would be sufficient to support the weight of a small version of the lamp 10, such as an individual reading lamp.

It is evident that one or more of the secondary brackets, such as brackets 36 and 38, can be positioned against walls, on the back surfaces of sofas, on bed headboards, on the back surfaces of reclining chairs, and other structures which normally do not allow for attachment of a lamp thereto. As for instance, if the brackets 36 and 38 were positioned on the left and right upper hand back corners of a recliner, the lamp 10 could be used for reading purposes of the occupant of the recliner, with the occupant being able to choose whether or not the lamp 10 is positioned over his right shoulder or his left shoulder, or even allowing for convenient switching of the lamp 10 from one bracket 36 to the other bracket 38 if for some reason the occupant of the recliner wishes to switch the direction from which the light is being received. It is further evident that by use of the lamp 10 in a scenario as described in the preceding sentence, the on/off switch 14 would be conveniently located to the occupant of the recliner allowing for convenient turning off and on of the lamp.

It is also evident that because of the ability of positioning the lamp 10 very near the occupant, such as right over the occupant's shoulder in a chair or recliner or the like, a very small wattage bulb can be utilized in the lamp 10 which minimizes not only electrical consumption, but the effect the light emitted by the lamp 10 has on other occupants of the room, such as when a room is simultaneously being used by one occupant for reading, and the other for watching TV or sleeping, or the like. The goose-neck portions 18 of the lamp 10 allow for flexing of the lamp 10 to directly position the light as desired by the occupant.

It is further evident that a plurality of the lamps 10 could be utilized against vertical surfaces for illuminating pictures or other works of art by simply swiveling the goose necks such that the light from the light 10 projected back toward the support surface. Additionally, it is evident that one or more of the lamps 10 could be utilized in a room for lighting or reading purposes and then be conveniently moved when the room was to be used for entertaining, or other purposes wherein different lighting effects are desired.

While, for purposes of the illustrative embodiment, the ribs 32 and 34 have been described as being formed on the main bracket 24 and the grooves 44 and 46 on the secondary brackets 36, these, in effect, could be reversed with the grooves being formed on the main bracket and the ribs being formed on the secondary bracket. In any event, it is evident that by utilizing a combination of ribs and grooves, when the main bracket 24 is attached to the secondary bracket 36, the main bracket 24 is prevented from rotating in two planes, that is either for and aft as viewed in FIG. 1, or side to side in FIG. 1, allowing for the use of the lamp 10 on irregular or inclining surfaces such as on the back of a recliner or the like. With the utilization of the set screw 28 and the tubular portion 20, the lamp 10 of the illustrative embodiment can be rotated along the vertical axis. However, as described above, the neck 16 could be fixed to the bracket 24 and rotation in this axis would also be limited.

I claim:

1. A lamp consisting of a first bracket for attaching to a support surface, said first bracket comprising an integrally formed elongated member having a front, a flat planar back, a top, a bottom, and essentially parallel left and right sides;

said first bracket further including at least one aperture extending between said front and back of said first bracket, said aperture for receiving a fastening member for attaching said first bracket to a support surface with the back of said first bracket positioned towards said support surface;

a second bracket for attaching to said first bracket, said second bracket being elongated and including at least a back, a top, a bottom, and essentially parallel left and right side edges;

one of said first bracket and said second bracket including first and second elongated grooves formed on one of said first and said second brackets, said first and said second elongated grooves located essentially parallel to one another and spaced apart from one another and oriented with respect to one another so as to open opposed to one another;

the other of said first and said second brackets including first and second elongated ribs, said first and said second elongated ribs located essentially parallel to one another and sized and shaped and positioned on the other of said first and said second brackets in a spaced relationship such that said first elongated rib fits into said first groove and said second elongated rib fits into said second groove to mate said second bracket to said first bracket;

limiting means located on one of said first and said second brackets for maintaining said second bracket mated to said first bracket to temporarily attach said second bracket to said first bracket;

an elongated lamp neck having ends, said lamp neck being hollow;

an electric light attaching to one of said ends of said lamp neck and including electrical wiring attaching to said electric light and passing through said hollow lamp neck and exiting out of the other of said ends of said hollow neck;

said second bracket including an elongated hollow cylindrical opening in said second bracket, said opening extending between the top and bottom of said second bracket, said neck opening sized and shaped to accept at least a portion of said elongated lamp neck in said opening;

said elongated lamp neck operatively attaching to said second bracket proximal to said other of said ends of said neck by fitting into said elongated hollow cylindrical opening in said second bracket whereby said neck and said lamp attached therto are supported by said second bracket which in turn is supported on said first bracket which is in turn supported on a support surface.

2. The lamp of claim 1 wherein:

said first and said second grooves are located on said first bracket along the left and right side edges of said first bracket such that said first elongated groove opens up on the left side edge of said first bracket and said second elongated groove opens up on the right side edge of said first bracket.

3. The lamp of claim 2 wherein:

said first and said second elongated ribs are located on said second bracket and are positioned on said second bracket so as to extend from the respective left and right side edges of said second bracket toward one another.

4. The lamp of claim 2 wherein:

in cross section, said first and said second grooves define a web positioned between said front and said back of said first bracket;

said front of said first bracket includes a front surface portion, said first bracket front surface portion in cross section being of a narrower width as measured between the sides of said first bracket than is the width of said first bracket as measured between the sides of said first bracket across the width of said back of said first bracket.

5. The lamp of claim 1 wherein:

at least a portion of said elongated lamp neck comprises a flexible tube capable of being positioned in a variety of positions and temporarily retaining each of said postions.

6. The lamp of claim 1 wherein:

said lamp further including a retaining means located on one of said second bracket and said lamp neck, said retaining means for temporarily holding said lamp neck within said elongated opening on said second bracket.

7. The lamp of claim 6 wherein:

said retaining means comprises set screw means located on said second bracket for temporarily fixing the position of said elongated neck within said elongated opening on said second bracket.

8. The lamp of claim 1 wherein:

said limiting means comprises a limiting member extending between the front and back of one of said first bracket and said second bracket, said limiting member inhibiting downward movement of said elongated ribs in said elongated grooves.

9. The lamp of claim 8 wherein:

said limiting member is located on said first bracket along the bottom of said first bracket between the front and back of said first bracket.

10. The lamp of claim 8 wherein:

said limiting member is located on said second bracket on the top of said bracket between the front and back of said second bracket.

11. The lamp of claim 1 including:

a plurality of said first brackets, each of said first brackets attachable to a different support surface to allow said second bracket to be temporarily attached to each of said first brackets one at a time to temporarily locate said second bracket on the support surface to which each of said plurality of said first brackets is attached.

* * * * *